United States Patent [19]

Lee

[11] Patent Number: 4,979,907

[45] Date of Patent: Dec. 25, 1990

[54] OUTLET STRIP ASSEMBLY WITH INTEGRAL MULTIPLE RECEPTACLES

[76] Inventor: James Lee, 2 Fl., No. 169, Sec. 2, Chung An E. Rd., Taipei, Taiwan

[21] Appl. No.: 472,641

[22] Filed: Jan. 30, 1990

[51] Int. Cl.[5] ..... H01R 25/16

[52] U.S. Cl. ..... 439/214; 439/652

[58] Field of Search ..... 439/207, 209–212, 439/214, 216, 107, 502, 650, 652, 686, 687, 690, 701

[56] References Cited

U.S. PATENT DOCUMENTS 3,478,295 11/1969 Grieshaber ..... 439/650

OTHER PUBLICATIONS

Four (4) catalog pages of Prior Art outlet strip assemblies.

*Primary Examiner*—Gary F. Paumen

*Attorney, Agent, or Firm*—Thomas S. Keaty

[57] ABSTRACT

An outlet strip assembly comprises a multiple receptacle mechanism which is formed of a single piece separate from the cover plate. The multiple receptacle mechanism receives three bus bars to establish a complete electrical connection for electrical plugs and power lines. The multiple receptacle mechanism is press-fitted to a base via a linking mechanism. A cover plate adapted to cover the multiple receptacle mechanism can be made of any suitable material and color.

7 Claims, 3 Drawing Sheets

OUTLET STRIP ASSEMBLY WITH INTEGRAL MULTIPLE RECEPTACLES

BACKGROUND OF THE INVENTION

The present invention relates generally to an outlet strip assembly. More particularly, the present invention relates to an outlet strip assembly comprising a multiple receptacle which is releasably mounted on a base and in the form of an integral piece.

Two types of outlet strips are widely utilized at present. The conventional type of outlet strip assembly generally comprises a cover plate, an adjacent base and receptacles in the form of singular piece or pairs, in addition to necessary electrical elements disposed therein or connected thereto to establish a complete electrical connection. As is required, the cover plate and adjacent base are both made of metals and the receptacles are made of insulated materials such as plastics. Each pair of receptacles are separately and securely mounted on the cover plate by screws or the like, with wires connecting common positive or negative terminals to respective receptacles. One obvious drawback of such construction is that the work required for separately mounting each pair of receptacles on the cover plate and for connecting adjacent receptacles by wires can be time-consuming.

The more recent type of outlet strip assembly comprises a cover plate having all receptacles integrally formed thereon, an adjacent base associated with the cover plate, and three bus bars (for hot wire, neutral wire and grounding wire, respectively) running through each and every receptacle. The cover plate and the adjacent base are preferably made of plastic material, for example, by injection molding. As is apparent, in this type of outlet strip assembly, the bus bars replace the wires for connecting common positive or negative terminals of respective receptacle and the electrical elements received within the receptacles. Further, the receptacles are permanently fixed on the cover plate forming an integral part thereof. While this type of outlet strip assembly is simple in construction it still has drawbacks. For instance, since the receptacles are integrally and fixedly formed on the cover plate, it is difficult, if not impossible, to have the cover plate and the receptacles made of separate colors. In addition, it is not possible that the cover plate be made of conductive materials such as metal, as desired in some situations.

SUMMARY OF THE INVENTION

To improve the above types of outlet strip assemblies, the present invention has made improvements by further separating or detaching the receptacles from the cover plate and by providing a linking means between the multiple receptacle means and the base. It is noted that with the receptacles, or so called multiple receptacle means referred to hereinafter in this disclosure, and the cover plate thus separately provided, the adaptability of the outlet strip assembly is enhanced; in particular, the cover plate can be fabricated of a conductive material such as metal. This specific feature is not present if the cover plate and the receptacles are integrally formed by injection molding. Also, the cover plate of the present invention can be made of a different color than the multiple receptacle means. In accordance with the present invention, an improved outlet strip assembly of the type described above is not complicated in construction and easy to manufacture and assemble. Further, with the multiple receptacle means separately provided to be releasably fixed on the base but not integrally formed with the cover plate, it is possible to have all the advantages of the known types of outlet strips described above and avoids any of the drawbacks associated with each.

Therefore, a primary objective of the present invention is to provide an outlet strip assembly comprising a multiple receptacle means separate from the cover plate and formed of a single piece to enhance its adaptability.

Another objective of the present invention is to provide an outlet strip assembly which is easy to manufacture and assemble.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
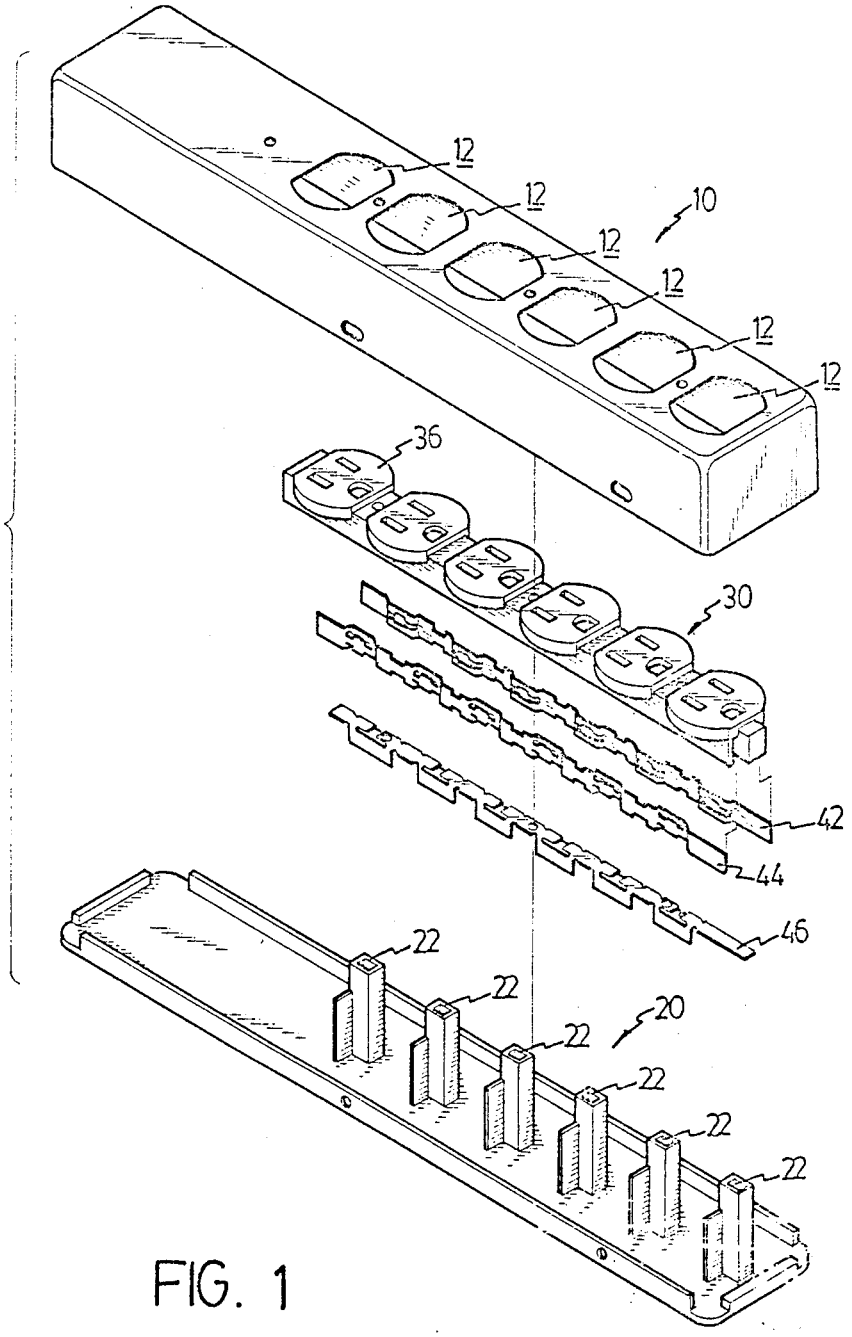
FIG. 1 is a exploded view showing the outlet strip assembly according to the present invention.

Referring now to the drawings, and more particularly to FIG. 1, there is shown the outlet strip assembly which incorporates the preferred embodiment of the present invention. Although the outlet strip assembly shown in FIG. 1 does specifically show conventional elements, such as conducting leads connected to respective bus bars to construct a complete electrical connection, it is within the scope of the invention to utilize the separately provided multiple receptacle means herein disclosed with other known elements to form a readily usable outlet strip assembly for electrical plugs.

Figure 3:
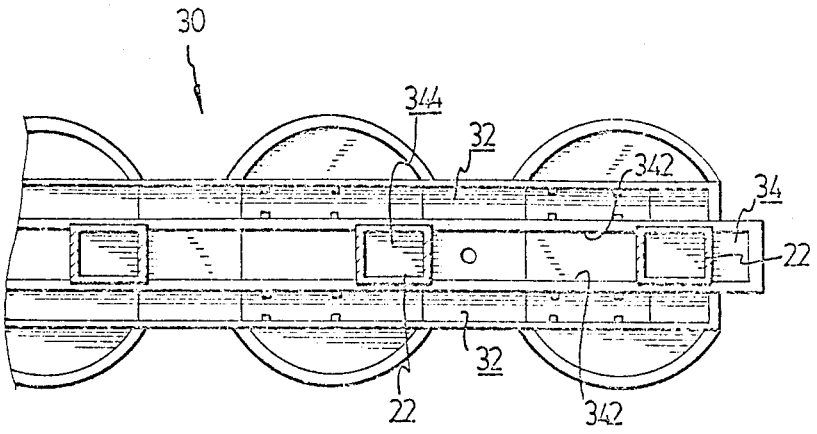
FIG. 3 is a bottom plan view showing particularly the detailed description of the multiple receptacle means.

As shown in FIG. 1, the outlet strip assembly of the present invention comprises a cover plate 10, an adjacent base 20, and a multiple receptacle means 30 for receiving three bus bars 42, 44 and 46. The cover plate 10 has a plurality of holes 12, in this embodiment six, longitudinally spaced on a top surface thereof. The base 20 has a corresponding number of stands 22 longitudinally spaced thereon. The three bus bars 42, 44 and 46 are disposed within three corresponding channels 32, 32 and 34 (referring to FIGS. 3 and 4) formed on the multiple receptacle means 30, such that when electrical plugs (not shown) are inserted into the slots on the multiple receptacle means, electrical connection will be established. It should be noted that the cover plate 10, the base 20 and the three bus bars 42, 44 and 46 are known elements per se in this art and do not play a part in this invention such that detailed description thereof seems unnecessary.

As described above, the characteristics of the present invention lie in that the multiple receptacle means 30 is in an integral form, comprising a plurality of receptacles 36, and separate from the cover plate 10 to engage with the base 20, as will be further described hereinbelow.

Figure 2:
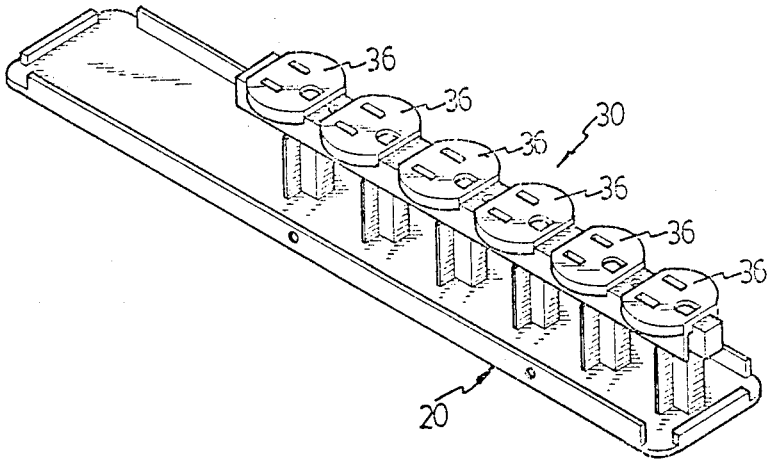
FIG. 2 is a perspective view showing the multiple receptacle means releasably mounted on the adjacent base, the cover plate being removed for simplicity.

Referring to FIG. 2, there is shown the multiple receptacle means 30 mounted on the base 20. As seen from FIG. 3, which shows a bottom plan view of the multiple receptacle means 30, there are elongated bulges 342 in pairs along the walls of the intermediary channel 34. The longitudinal length of each bulge 342 is such that a receiving portion is formed between two adjacent pair of bulges 342. The receiving portion 344 is provided to receive the stand 22 of the base 20. It is noted that the stand 22 has a rectangular cross-section that is only slightly less than the area of the receiving portion 344 such that the multiple receptacle means 30 is easily and securely mounted on the stand 22 of the base 20 in a press-fit manner. Therefore, the multiple receptacle means 30 can be releasably mounted on the base 20 as shown in FIG. 2.

Figure 4:
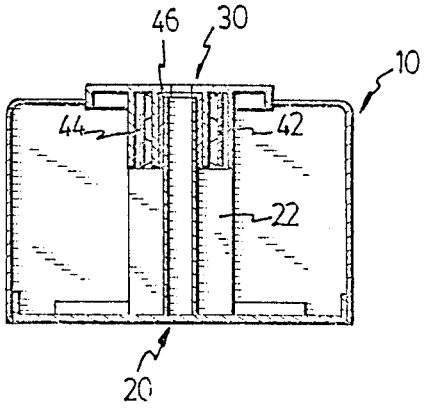
FIG. 4 is a cross-sectional view showing the interrelationship between the elements of the outlet strip assembly of FIG. 1.

FIG. 4 shows the multiple receptacle means 30 mounted on the plurality of stands 22 of the base 20, with the cover plate 10 mounted on the base 20. As can be understood from FIG. 1, the holes 12 on the cover plate 10 are adapted to accommodate corresponding multi-apertured receptacles 36 on the multiple receptacle means 30 such that the receptacles 36 will protrude over the cover plate 10 when the cover plate 10 is mounted on the base plate 20. It is noted that a feature of the present embodiment of this invention lies in that the multiple receptacle means 30 is designed to be press-fitted to the base plate 20 instead of being fastened to the cover plate 10, sometimes in a permanent manner, as found in prior art. However, the threading engagement between the multiple receptacle means 30 and the cover plate 10 can be achieved in a known manner, such that the multiple receptacle means 30 is mounted on the cover plate 10, if so desired. Another feature of the present embodiment of this invention is that the cover plate 10 can be suitably made of conductive or insulated material. Furthermore, the cover plate 10 can be of a different color than that of the multiple receptacle means 30 due to the fact that the multiple receptacle means 30 is separate from the cover plate 10 and shaped as a single piece.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. An outlet strip assembly used for electrical plugs comprising a cover plate mounted directly on an adjacent base, a multiple receptacle means receiving three bus bars, said cover plate having a plurality of holes longitudinally spaced on a top surface thereof; wherein the improvements comprise:

said multiple receptacle means being separate from said cover plate and being of a single piece;

said multiple receptacle means being releasably fixed on said adjacent base by a linking means, said multiple receptacle means carrying a plurality of multi-apertured receptacles each corresponding to one of said holes; and wherein said adjacent base and said cover plate substantially enclose all but said receptacles of said multiple receptacle means.

2. An outlet strip assembly for electrical plugs as claimed in claim 1, wherein said cover plate is made of conductive material.

3. An outlet strip assembly for electrical plugs as claimed in claim 2, wherein said cover plate is made of metal.

4. An outlet strip assembly for electrical plugs as claimed in claim 1, wherein said cover plate is made of insulated material.

5. An outlet strip assembly for electrical plugs as claimed in claim 2, wherein said cover is made of plastic.

6. An outlet strip assembly for electrical plugs as claimed in claim 1, wherein said multiple receptacle means has a different color than said cover plate.

7. An outlet strip assembly for electrical plugs as claimed in claim 1, wherein said multiple receptacle means is press-fitted onto said adjacent base.

* * * * *